US005964129A

United States Patent [19]

Shiao

[11] Patent Number: 5,964,129

[45] Date of Patent: Oct. 12, 1999

[54] RATCHET WRENCH WITH A DIRECTION CONTROL RATCHET MEMBER

[76] Inventor: Hsuan-Sen Shiao, No. 15-1, Lane 369, Min-Chuan Rd., Taichung City, Taiwan

[21] Appl. No.: 09/128,994

[22] Filed: Aug. 4, 1998

[51] Int. Cl.[6] ..... B25B 13/46

[52] U.S. Cl. ..... 81/63.2; 81/58; 81/60

[58] Field of Search ..... 81/60, 58, 63.2

[56] References Cited

U.S. PATENT DOCUMENTS 1,119,292 12/1914 Lawson ..... 81/63.2

1,214,423 1/1917 Casper ..... 81/63.2

*Primary Examiner*—Timothy V. Eley

*Assistant Examiner*—Willie Berry, Jr.

*Attorney, Agent, or Firm*—Baker & Botts, LLP

[57] ABSTRACT

A ratchet wrench includes a handle which has a circular opening in a box end thereof to receive a circular adapter. A grip portion extends from the box end and has an opening that is defined by an upper wall thereof and that extends towards a lower wall to form a proximate abutting wall. A receiving chamber extends in a radial direction relative to a rotating axis of the circular opening between the proximate abutting wall and the circular opening. The adapter is rotatable about the rotating axis, and has an outer rim wall with a toothed surface. A ratchet member is disposed rotatably in the receiving chamber, and has at least one ratchet tooth at one end to be brought into engagement with the toothed surface by the biasing action of a biasing member. When the ratchet member is turned 180 degrees about the radial direction while it is pulled to disengage the ratchet tooth from the toothed surface, the direction of driven rotation of the adapter can be reversed.

7 Claims, 5 Drawing Sheets

RATCHET WRENCH WITH A DIRECTION CONTROL RATCHET MEMBER

BACKGROUND OF THE INVENTION

1. Field of the Invention

This invention relates to a ratchet wrench, more particularly to a ratchet wrench with a direction control ratchet member for controlling the direction of driven rotation of an adapter when turning a workpiece.

2. Description of the Related Art

Referring to FIG. 1, a conventional ratchet wrench is shown to include a handle 1 which has a box end with an inner circular wall 1*c* that defines a hole 1*a*. An adapter 2 is mounted in the hole 1*a*, and has an inner engaging wall 2*b* for engaging a workpiece, such as a screw nut or the head of a screw (not shown), to be turned, and an outer toothed surface 2*a*. A receiving groove 1*b* is formed in the inner peripheral wall 1*c*, and extends toward an outer peripheral wall 1*d* for receiving a ratchet member 4 and a spring 3. The ratchet member 4 has a plurality of ratchet teeth 4*a* for ratchet coupling with the toothed surface 2*a* by the biasing action of the spring 3. As such, the adapter 2 can be operated to turn the workpiece only when the handle 1 is rotated in a certain direction, i.e. in a counterclockwise direction, as shown in FIG. 1.

Once it is desired to turn the workpiece in an opposite direction, the entire handle 1 must be reversed by a 180-degree angle, thereby resulting in inconvenience during use. In addition, due to the limitation of the circular wall 1*c*, it is difficult to form the receiving groove 1*b*.

SUMMARY OF THE INVENTION

The object of the present invention is to provide a ratchet wrench with a direction control ratchet member for controlling the direction of driven rotation of an adapter when turning a workpiece.

According to this invention, a ratchet wrench includes a handle which has a box end with a circular opening that is defined by an inner circular wall and that has a central rotating axis. A grip portion extends from an outer peripheral wall of the box end, and is elongated in a longitudinal direction. The grip portion has an opening that is defined by an upper wall and that extends towards a lower wall so as to form a proximate abutting wall which extends in a transverse direction. A receiving chamber extends in a radial direction relative to the rotating axis between the proximate abutting wall and the inner circular wall. A circular adapter is disposed rotatably in the circular opening about the rotating axis, and has an outer rim wall with a toothed surface. A ratchet member is disposed rotatably in the receiving chamber, and has a stem which extends into the opening. An engaging head includes at least one ratchet tooth to be brought into engagement with the toothed surface by the biasing action of a biasing member. When the stem is turned 180 degrees about the radial direction while it is pulled to disengage the ratchet tooth from the toothed surface, the direction of driven rotation of the circular adapter can be reversed.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
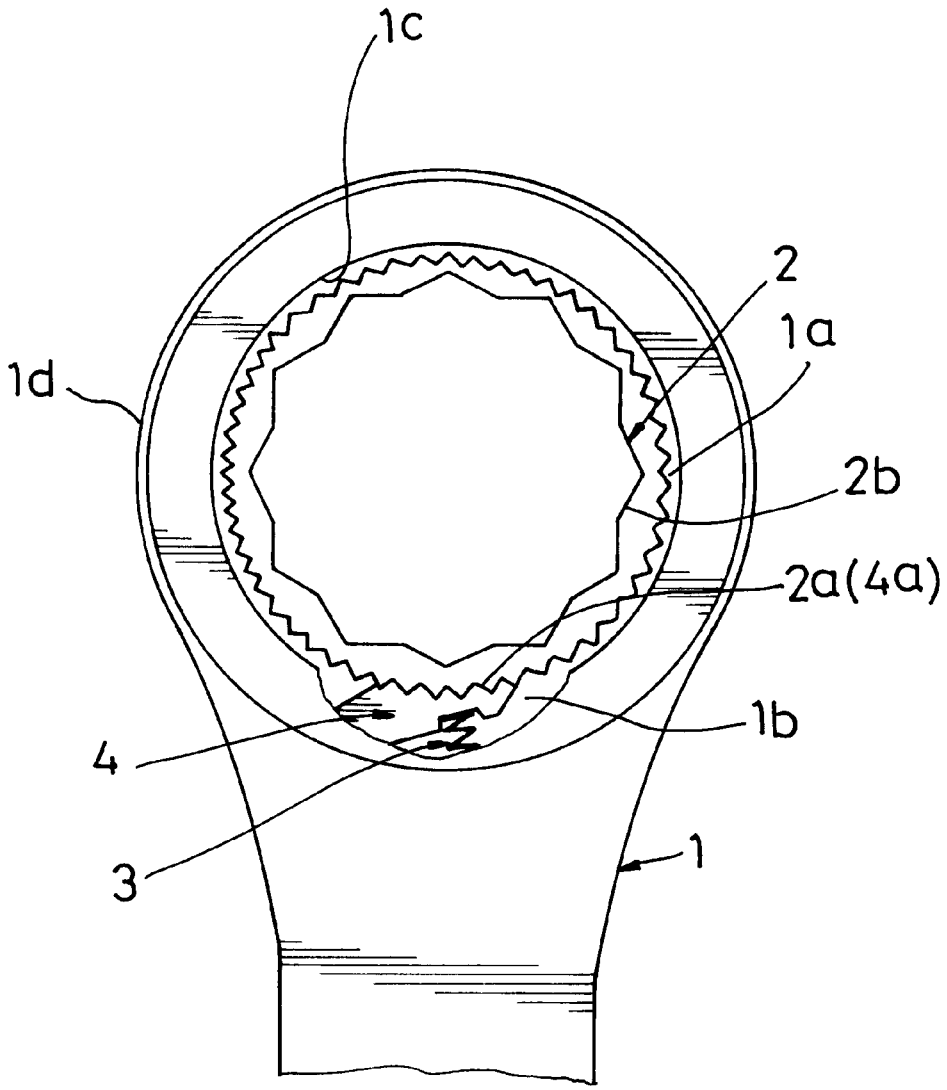
FIG.1 PRIOR ART
FIG. 1 is a schematic view of a portion of a conventional ratchet wrench.
Figure 2:
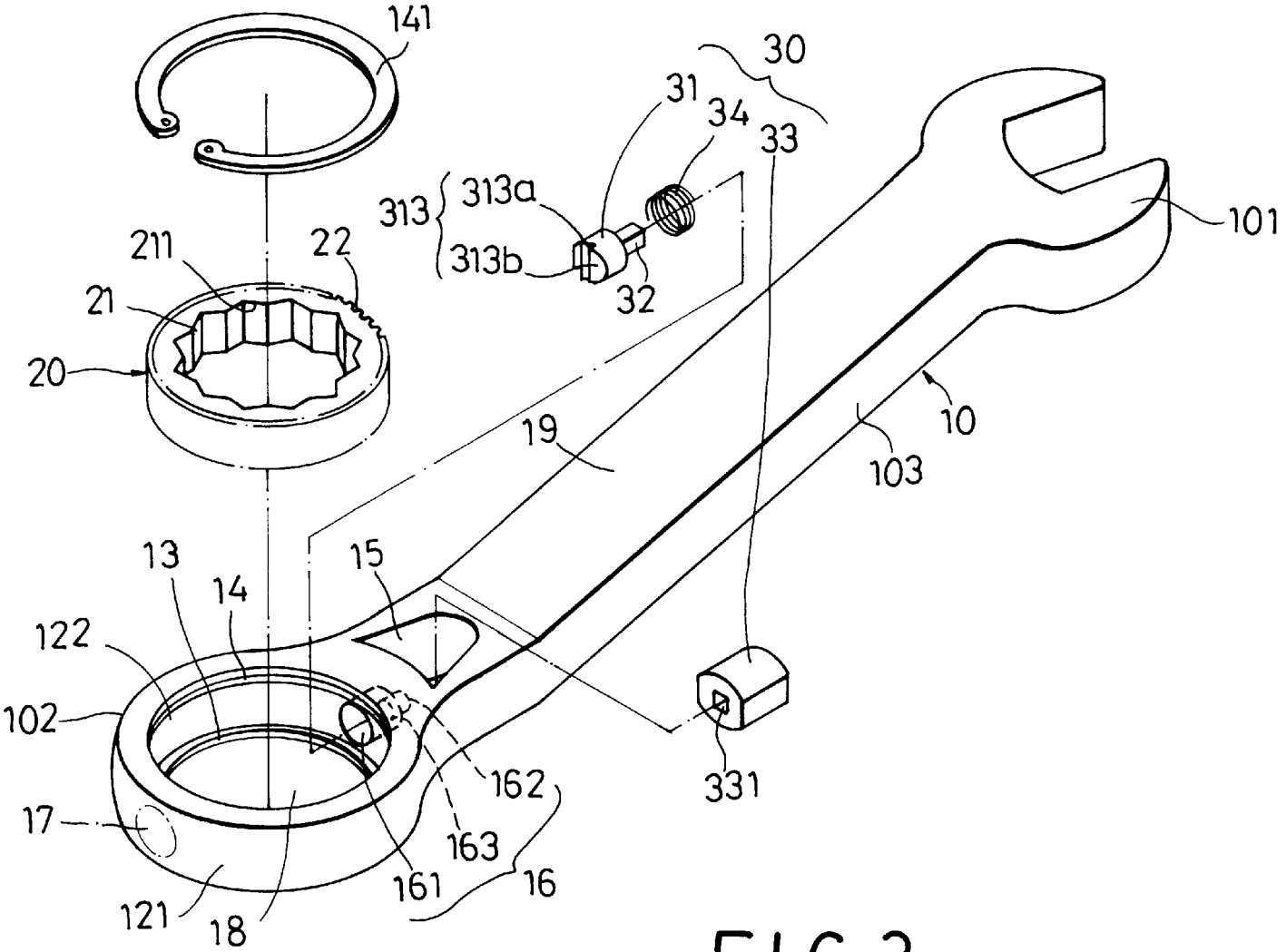
FIG. 2 is an exploded view of a first preferred embodiment of a ratchet wrench according to this invention.
Figure 3:
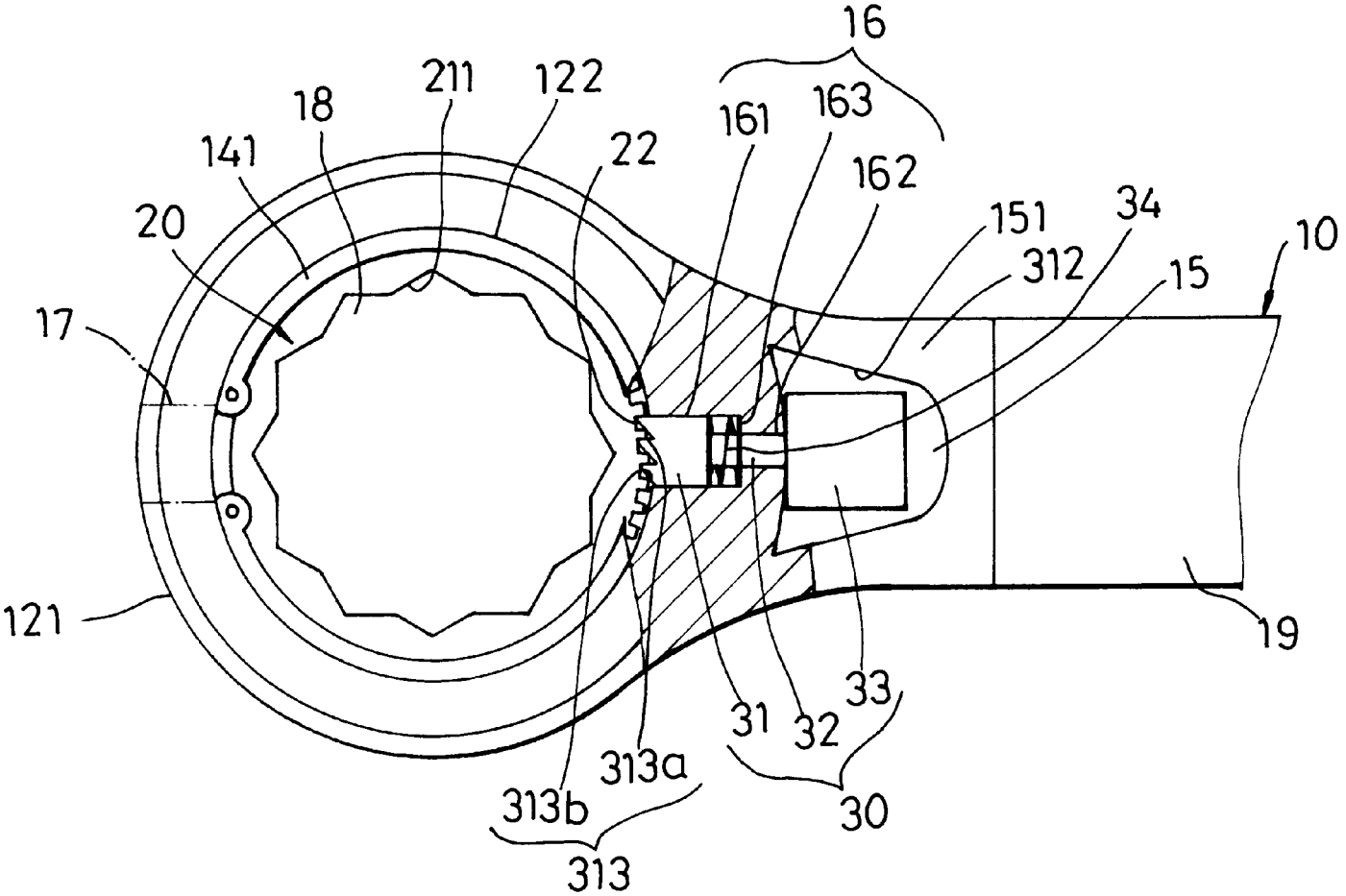
FIG. 3 is a partly sectional, schematic top view of a portion of the ratchet wrench of the first preferred embodiment in an engaging state.

Referring to FIGS. 2 and 3, the first preferred embodiment of a ratchet wrench according to the present invention is shown to comprise an elongate handle 10 which has an open end 101 and a box end 102.

The box end 102 has an outer peripheral wall 121 and an inner circular wall 122 which defines a circular opening 18 with a rotating axis that passes through a center thereof. The inner circular wall 122 is formed with an upper annular groove 14 and a lower annular flange 13.

A grip portion 103 includes proximate and distal ends which are connected respectively to the box and open ends 102,101, and an intermediate portion 19 which is interposed between the proximate and distal ends. The grip portion 103 has a lower wall and an upper wall which defines an opening 15 therein. The opening 15 extends towards the lower wall so as to form a proximate abutting wall 151 which extends in a direction transverse to a longitudinal direction of the grip portion 103 and which is proximate to the inner circular wall 122.

The proximate end further has a receiving chamber 16 that extends in a radial direction relative to the rotating axis between the proximate abutting wall 151 and the inner circular wall 122. The receiving chamber 16 includes a smaller bore 162 and a cylindrical bore 161 which are formed respectively in the proximate abutting wall 151 and the inner circular wall 122. The smaller bore 162 and the cylindrical bore 161 extend in the radial direction toward each other. The cylindrical bore 161 has a dimension bigger than that of the smaller bore 162 so as to form a shoulder seat 163 therebetween.

A circular adapter 20 is secured in the circular opening 18 in such a manner that a C-shaped ring 141 is engaged in the upper annular groove 14, and is rotatable relative to the inner circular wall 122 about the rotating axis. The adapter 20 has an inner peripheral wall 21 formed with a plurality of engaging teeth 211 for holding a workpiece (not shown) to be turned, and an outer rim wall with a toothed surface 22 which faces the inner circular wall 122.

A ratchet member 30 includes an engaging head 31, an operating knob 33, and a stem 32. The engaging head 31 is disposed rotatably in the cylindrical bore 161 and extends into the circular opening 18. The engaging head 31 includes three ratchet teeth 313 to be brought into engagement with the toothed surface 22 of the adapter 20. Each ratchet teeth 313 includes a radial side 313*a* and an inclined side 313*b* so that a tooth on the toothed surface 22 can catch on the former and slide over the latter. The stem 32 is connected integrally with the engaging head 31, and extends into the opening 15 via the smaller bore 162. The operating knob 33 has a connecting hole 331 for engaging the stem 32, and is disposed in the opening 15 to facilitate turning of the stem 32 about the radial direction.

A biasing spring 34 is sleeved on the stem 32 and is disposed in the cylindrical bore 161 between the shoulder seat 163 and the engaging head 31 for biasing the ratchet teeth 313 to engage the toothed surface 22.

In use, by virtue of the ratchet coupling between the ratchet teeth 313 and the toothed surface 22, when the inner peripheral wall 21 is sleeved on a workpiece, such as a screw nut or the head of a screw (not shown) the adapter 20 can be operated to turn the workpiece only when the handle 10 is rotated in a certain direction, i.e. in a counterclockwise direction, as shown in FIG. 3.

Figure 4:
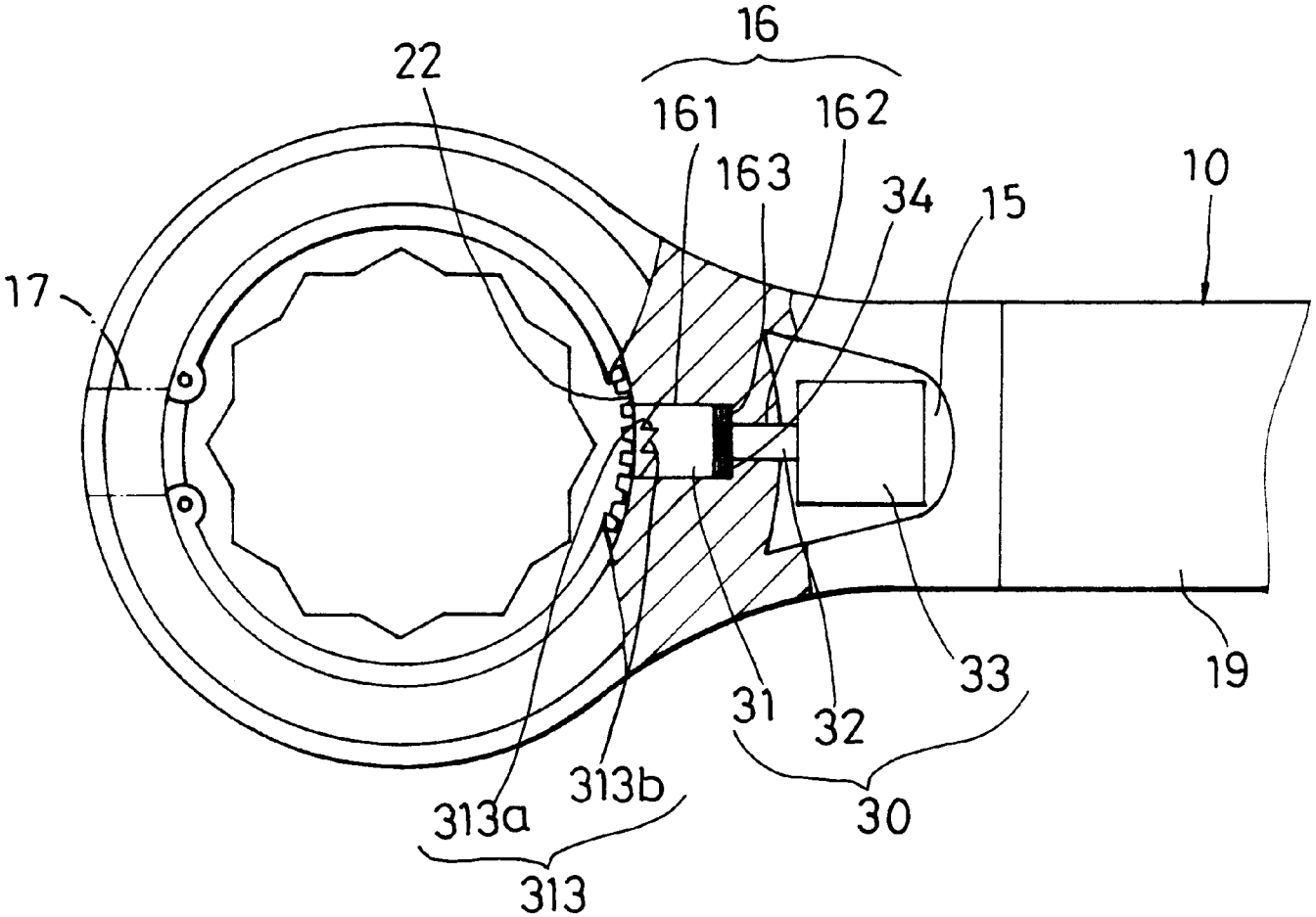
FIG. 4 is a partly sectional, schematic top view of the portion of the ratchet wrench of the first preferred embodiment in a disengaging state after a ratchet member is reversed from the position in FIG. 3.

When it is desired to turn the workpiece in the opposite direction, the operating knob 33 is pulled to disengage the ratchet teeth 313 from the toothed surface 22 against the biasing action of the spring 34. Then, the ratchet member 30 is turned 180 degrees about the radial direction, as shown in FIG. 4. As such, the direction of driven rotation of the adapter 20 can be reversed after releasing the operating knob 33 for ratchet coupling between the ratchet teeth 313 and the toothed surface 22.

As illustrated, the advantages of the ratchet wrench of this invention are as follows:

1. The opening 15 can be formed easily when the handle 10 is fabricated.
2. As shown in FIG. 4, a forming hole 17 is formed in the outer peripheral wall 121 and extends radially to the inner peripheral wall 122 and opposite to the receiving chamber 16 so as to facilitate forming of the receiving chamber 16 in a subsequent boring operation.
3. By operating the operating knob 33, the direction of driven rotation of the adapter 20 for turning the workpiece can be controlled, thereby resulting in convenience during use.

Moreover, since it is not required to reverse the entire handle 10 when changing the direction of driven ratation, the proximate end can be inclined relative to the intermediate portion 19 of the grip portion 103 for added convenience when turning workpieces in a concaved and/or narrow space.

Figure 5:
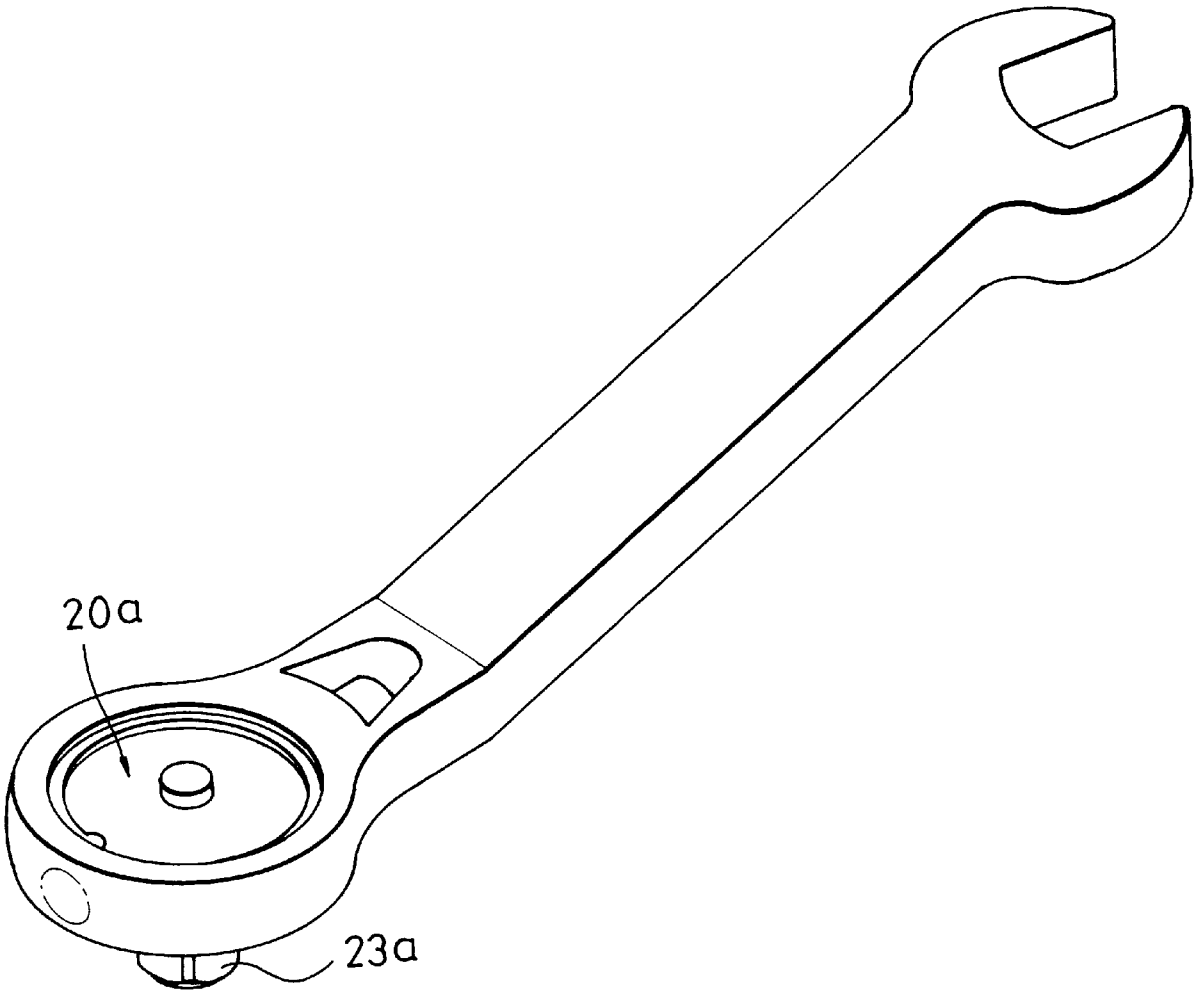
FIG. 5 is a perspective view of a second preferred embodiment of the ratchet wrench according to this invention.

Referring to FIG. 5, the second preferred embodiment of the ratchet wrench according to this invention is shown to be generally similar to the first preferred embodiment, except that the adapter 20*a* has a workpiece-coupling portion 23*a* which is transverse to the handle for sleeving a socket (not shown) thereon.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A ratchet wrench comprising:

a handle having a box end with an outer peripheral wall and an inner circular wall which defines a circular opening that has a rotating axis passing through a center thereof, and a grip portion extending from said outer peripheral wall and elongated in a longitudinal direction, said grip portion including a proximate end relative to said outer peripheral wall, said proximate end having a lower wall and an upper wall which defines a second opening therein that extends towards said lower wall so as to form a proximate abutting wall extending in a direction transverse to said longitudinal direction and proximate to said inner circular wall, said proximate end further having a receiving chamber that extends in a radial direction relative to said rotating axis between said proximate abutting wall and said inner circular wall;

a circular adapter disposed in said circular opening and rotatable relative to said inner circular wall about said rotating axis, said circular adapter being adapted for engaging a workpiece to be turned, and having an outer rim wall with a toothed surface facing said inner circular wall;

a ratchet member having a stem that is disposed rotatably in said receiving chamber and that extends into said second opening and an engaging head that is disposed rotatably in said receiving chamber and that extends from said stem into said circular opening, said engaging head including at least one ratchet tooth to be brought into engagement with said toothed surface; and a biasing member for biasing said ratchet tooth to engage said toothed surface;

whereby, once said stem is turned 180 degrees about said radial direction while it is pulled to disengage said ratchet tooth from said toothed surface against biasing action of said biasing member, the direction of driven rotation of said circular adapter will be reversed.

2. The ratchet wrench as claimed in claim 1, wherein said receiving chamber includes a smaller bore and a cylindrical bore formed respectively in said proximate abutting wall and said inner circular wall, and extending in said radial direction towards each other, said cylindrical bore having a dimension bigger than that of said smaller bore so as to form a shoulder seat therebetween.

3. The ratchet wrench as claimed in claim 2, wherein said stem and said engaging head of said ratchet member extend respectively into said smaller bore and said cylindrical bore, said biasing member being sleeved on said stem and being disposed in said cylindrical bore between said shoulder seat and said engaging head.

4. The ratchet wrench as claimed in claim 3, wherein said ratchet member further has an operating knob that is disposed in said second opening and that engages said stem to facilitate turning of said stem about said radial direction.

5. The ratchet wrench as claimed in claim 1, wherein said circular adapter further has an inner peripheral wall formed with a plurality of engaging teeth adapted for holding the workpiece.

6. The ratchet wrench as claimed in claim 1, wherein said circular adapter further has a workpiece-coupling portion transverse to said handle.

7. The ratchet wrench as claimed in claim 1, wherein said grip portion further includes a distal end opposite to said proximate end, and an intermediate portion interposed between said proximate and distal ends, said proximate end being inclined relative to said intermediate portion.

* * * * *